United States Patent [19]

Sherwood et al.

[11] 4,183,792

[45] Jan. 15, 1980

[54] METHOD AND CELL FOR ELECTROLYTIC OXIDATION OF $NI(OH)_2$ WITH STATIONARY BED ELECTRODE

[75] Inventors: Willam G. Sherwood; Paul B. Queneau, both of Golden, Colo.

[73] Assignee: Amax Inc., Greenwich, Conn.

[21] Appl. No.: 12,775

[22] Filed: Feb. 16, 1979

[51] Int. Cl.[2] ..... C25B 1/00; C25B 11/04

[52] U.S. Cl. ..... 204/96; 204/261

[58] Field of Search ..... 204/96, 261

[56] References Cited

U.S. PATENT DOCUMENTS

| | | | |
|---|---|---|---|
| 3,489,664 | 1/1970 | Popat et al. | 204/96 |
| 3,759,814 | 9/1973 | Nakagawa et al. | 204/96 |
| 3,841,989 | 10/1974 | Delsa | 204/96 |
| 3,951,765 | 4/1976 | Everett | 204/96 |

FOREIGN PATENT DOCUMENTS

| | | | |
|---|---|---|---|
| 792737 | 8/1968 | Canada | 204/96 |

*Primary Examiner*—R. L. Andrews

*Attorney, Agent, or Firm*—Michael A. Ciomek; Eugene J. Kalil

[57] ABSTRACT

A method and cell are provided for anodically oxidizing a metal hydroxide slurry from a state of lower valence to a state of higher valence, the cell comprising an anode in the form of a bed of nickel pellets and a plurality of parallel-connected cathodes extending into said bed of pellets, each of the cathodes being covered by a perforated layer of insulating material to inhibit electrical shorting of said cathodes with said bed of nickel pellets.

36 Claims, 8 Drawing Figures

METHOD AND CELL FOR ELECTROLYTIC OXIDATION OF $NI(OH)_2$ WITH STATIONARY BED ELECTRODE

This invention relates to the electrolytic oxidation of a metal hydroxide slurry from a state of lower valence to a state of higher valence and also to an electrolytic cell structure characterized by an anode of high surface area.

STATE OF THE ART

The electrolytic oxidation of nickel from the nickelous ($Ni^{+2}$) to the nickelic state (e.g., $Ni^{+3}$ and/or $Ni^{+4}$) is generally employed as a first step in Ni/Co separation, particularly with regard to sulfuric acid leach solutions obtained in the sulfuric acid leaching of certain nickel ores, such as the limonitic and/or serpentinic nickel ores. Nickelous hydroxide is oxidized to the nickelic form, the nickelic hydroxide being thereafter used to convert the cobaltous ion in solution to the cobaltic state for the subsequent separation thereof from the nickel solution.

The aforementioned method is performed in a conventional parallel plate electrolytic cell using $Ni(OH)_2$ slurry containing free sodium hydroxide in an amount ranging from about 5 to 20 gpl (grams per liter). The current efficiency for nickelous conversion is in the neighborhood of 15 to 25%, the current per cell being about 10,000 amps, the voltage being about 3.

Some of the disadvantages with the aforementioned methods are as follows: (1) high power consumption (high current density) coupled with low current efficiencies; (2) a tendency toward anode corrosion, even with low levels of chloride ion, which requires costly time consuming effort to maintain the cells in usable condition; and (3) in addition, the maximum nickel concentration is limited to about 30 gpl due to high slurry viscosities and associated poor agitation.

We have surprisingly found that we can overcome the aforementioned difficulties and disadvantages by increasing the surface area of the anode, this being achieved by employing a fixed anode bed of nickel pellets or shot which enables the use of low current densities and the accompanying advantage of lower power consumption by working at the upper range of current efficiencies. Thus, any corrosion that occurs at the anode can be simply dealt with by the addition of nickel shot to the bed or simply replacing the bed with a fresh batch of nickel shot.

OBJECTS OF THE INVENTION

It is an object of the invention to provide an improved method for electrolytically oxidizing a metal hydroxide from a state of lower valence to a state of higher valence.

Another object is to provide a method for efficiently converting nickelous hydroxide to the nickelic state by using a fixed bed anode comprising nickel shot.

A further object is to provide an improved electrolytic oxidation cell for converting metal hydroxide from a state of lower valence to a state of higher valence.

These and other objects will more clearly appear when taken in conjunction with the following disclosure and the accompanying drawings, wherein.

STATEMENT OF THE INVENTION

Figure 1:
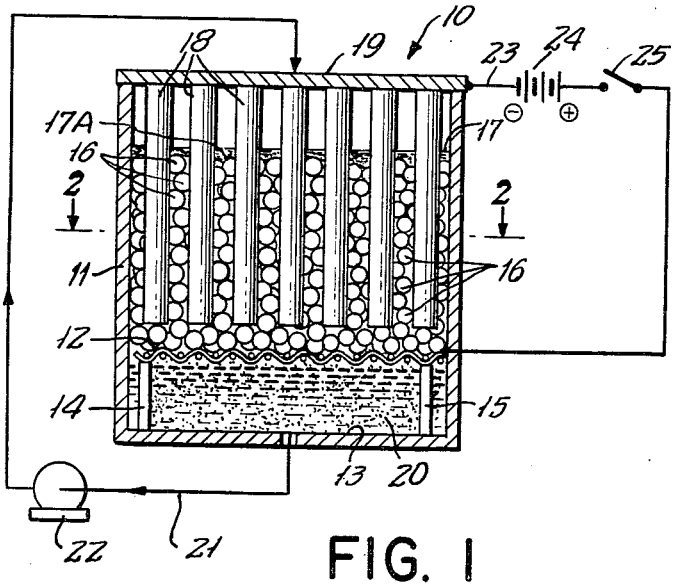
FIG. 1 is a schematic of one embodiment of an electrolytic oxidation cell provided by the invention, FIG. 2 being a cross section of the cell of FIG. 1 as viewed along line 2—2.

One embodiment of the invention resides in a method of oxidizing nickelous hydroxide to substantially the nickelic state, the method comprising forming an aqueous slurry of nickelous hydroxide containing free sodium hydroxide which is then fed to an electrolytic oxidation cell comprising an anode in the form of a supported fixed bed of nickel pellets and a plurality of parallel-connected cathodes extending into the body of said bed and in contact with said pellets. The cathodes are each covered with a perforated layer of insulating material. The cell is electrically activated and the hydroxide slurry circulated through the anode bed for a time sufficient to effect oxidation of the nickelous hydroxide to substantially the nickelic state.

The term "perforated" or "perforation" used herein is intended to cover broadly and porous insulating material covering the cathode no matter how the pores are produced, whether by piercing very small holes in the sheathing (e.g., polyethylene) or by using a woven material, such as woven nylon, or any other porous structure, so long as the size of the pores is such that shorting does not occur by contact of the coated or sheathed cathode with the nickel pellets.

Another embodiment resides in an improved cell for anodically oxidizing a metal hydroxide slurry from a state of lower valence to a state of higher valence, the cell comprising an anode in the form of a supported bed of nickel pellets with a plurality of parallel-connected cathodes extending into and in contact with the bed of pellets, the cathodes each being covered by a perforated layer of insulating material to inhibit electrical shorting of said cathodes with the bed of nickel pellets, means being provided for maintaining circulation of the metal hydroxide slurry throughout the bed of nickel pellets during electrical activation of the cell.

Another advantage of the invention is that nickelous hydroxide can be oxidized to trivalent and tetravalent nickel in electrolytic cells of the invention of virtually any dimension that will permit the introduction of a bed of nickel shot (e.g., shot ranging in diameter from about $\frac{1}{4}$ inch to $\frac{3}{4}$ inch). Diaphragmed cathodes of stainless steel have been employed spaced $\frac{1}{2}$ inch apart. As an example, in testing the concept of the invention, a cell 5 inches in diameter has been employed using nickel shot of about $\frac{3}{8}$ inch diameter. The cathodes may take several forms. For example, either cathode rods or plates may be employed in carrying out the invention.

A further advantage of the invention is that the use of an anode bed of nickel shot enables the treatment of slurries containing upwards of 60 gpl $Ni^{+2}$ [as $Ni(OH)_2$] or higher as compared to 30 gpl $Ni^{+2}$ employed in the conventional parallel plate system. For example, at a current flow corresponding to 12.5 amps per liter of slurry containing 10 gpl free NaOH, a current efficiency of 20% is obtained. Moreover, operating under such conditions reduces the requisite cell volume by a factor of about eight over the conventional cell using electrodes as parallel plates. An anode bed greatly reduces the size of the anode portion of the cell.

DETAILS OF THE INVENTION

Tests were conducted using two types of cells, one in which the cathodes are in the form of stainless steel rods and the other in which the cathodes are in the form of plates. As illustrative of such cells, reference is made to the schematics of FIGS. 1 to 4.

Referring to FIG. 1, a cell 10 is shown partially broken away comprising a cylindrical container 11 of plexiglass containing a foraminous partition 12 of stainless steel mesh (or slotted stainless steel plate) supported from the bottom 13 by legs 14, 15, the partition supporting a fixed bed of nickel pellets 16 of about ⅜ inch diameter (or other suitable size). The bed extends upwardly in the cell to a level 17A which is generally slightly lower than the level of the slurry. That is, the slurry should be at least sufficient to cover the anode bed.

A plurality of cathode rods 18 extends downwardly into the bed as shown, the cathode rods being attached to an electrically conductive header plate 19 which covers the cell. The cathode rods are encased in perforated polyethylene tubing (note FIG. 5) so as to avoid electrical shorting with the contacting nickel pellets 16.

A nickel hydroxide slurry ($Ni^{+2}$) 20 shown at the bottom of the cell extends to level 17 which is slightly above level 17A of the anode bed. The slurry is continuously pumped via line 21 and pump 22 to the top of the cell so as to maintain a uniformly mixed slurry throughout the interstices of the nickel pellets which are packed in random self-locating relationship with each other, such as billiard balls are packed. The slurry is circulated from the bottom to the top of the cell as shown.

The cell is electrically activated as shown schematically, the cathode header being electrically coupled via line 23 to a direct current power source 24 (for example, a direct current converter) which in turn is coupled via a switch 25 to the foraminous stainless steel partition 12 or other convenient location.

Figure 2:
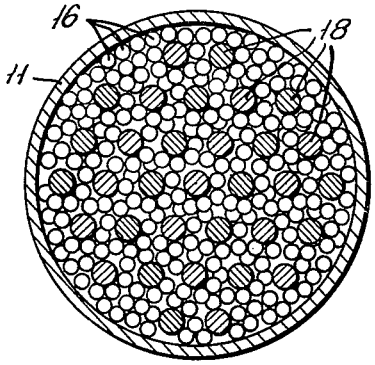

A cross section of the cell is depicted in FIG. 2 which shows the axial arrangement of cathode rods 18 throughout the cell cross section.

Figure 3:
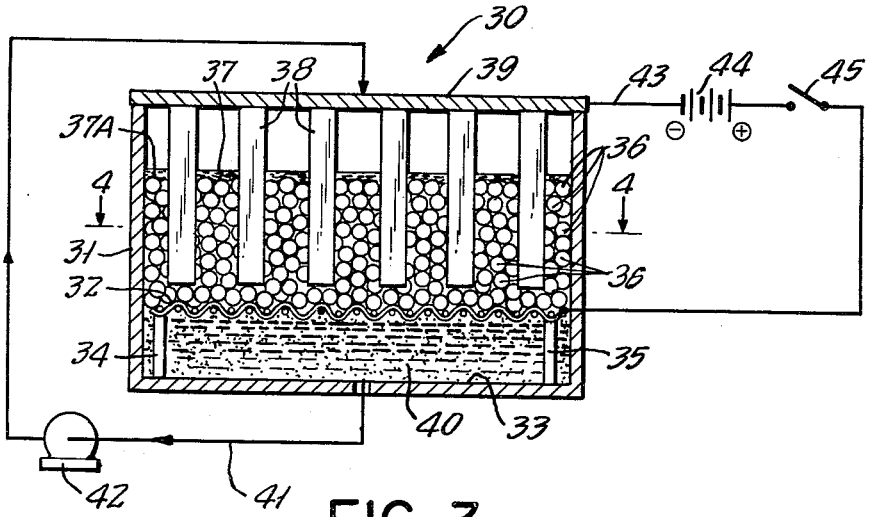
FIG. 3 is a schematic representation of another embodiment of an electrolytic oxidation cell provided by the invention, FIG. 4 being a cross section of the cell as viewed along line 4—4.

In FIG. 3, another embodiment is shown of a rectangular cell using cathode stainless steel plates instead of rod. However, the cell can be circular as well. Referring to FIG. 3, a cell 30 is shown partially broken away comprising a rectangular container 31 of plexiglass or other suitable material containing a foraminous partition 32 of stainless steel mesh supported from the bottom 33 by legs 34, 35, the partition similarly supporting a fixed bed of nickel pellets 36 of about ⅜ inch diameter. The bed extends upwardly in the cell to a level 37A which is slightly below the level 37 of the slurry.

A plurality of cathode plates 38 extends downwardly into the bed as shown, the cathode plates being attached to an electrically conductive header plate 39 which covers the cell. As in FIG. 1, the cathode plates are each covered with a nylon screen (40×40 thread count) to avoid anode-cathode shorting (note FIG. 6).

A nickelous hydroxide slurry 40 shown at the bottom of the cell extends to level 37. The slurry as in FIG. 1 is continuously pumped via line 41 and pump 42 to the top of the cell in order to maintain the slurry uniformly mixed throughout the bed of nickel pellets. The cell is electrically activated as shown schematically, the cathode header 39 being electrically coupled via line 43 to a direct current power source 44 which in turn is coupled via switch 45 to the foraminous stainless steel partition 32.

Figure 4:
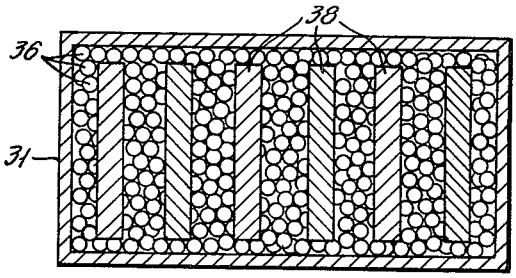

A cross section of the cell is shown in FIG. 4 which illustrates the parallel arrangement of cathode plates 38.

Figure 5:
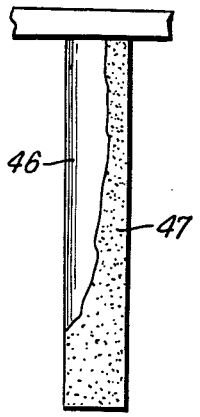
FIG. 5 is illustrative of a cathode rod encased in a tubing of perforated polyethylene as an insulating material.
Figure 6:
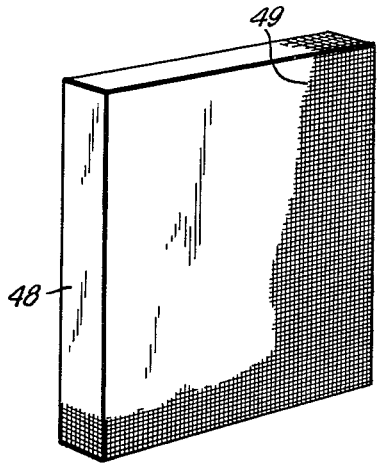
FIG. 6 depicts a cathode plate covered with a woven nylon screen to insulate said cathode from the bed of a nickel pellets.

FIG. 5 depicts a cathode rod of stainless steel 46 encased with a perforated tubing 47 of polyethylene broken away to show the substrate metal. In FIG. 6, a cathode plate is shown made of stainless steel 48 covered with a nylon screen 49 broken away to show the substrate metal. Any metal capable of resisting corrosion may be employed as the electrodes. Examples of such metals are lead, titanium, nickel-chromium alloys, etc.

EXAMPLE

Tests were conducted using three cells of circular configuration. Cell No. 1 contained nineteen ⅜ inch diameter stainless cathode rods each encased in a perforated polyethylene tubing. The total cathode area in this cell was approximately 315 $cm^2$, 30% of which was exposed through the perforations. The anode shot which weighed 4000 grams and had an average diameter of about ⅜ inch exhibited an anode weight exposed cathode area ratio of 42 grams of pellets/$cm^2$. Converting the 42 grams of pellets to surface area, the ratio becomes 30 $cm^2$ of anode surface per $cm^2$ of exposed cathode area.

As will clearly appear, the ratio of anode area to cathode area is very large. The slurry capacity of Cell No. 1 was 2 liters.

Cells No. 2 and No. 3 contained five stainless steel plate cathodes, each covered with a nylon screen (40×40 thread count) as shown in FIG. 6 to prevent anode-cathode shorting. Approximately 75% of the available cathode area was exposed through the membrane.

Cell No. 2 contained 4000 grams of shot (about ⅜ inch diameter) covering 8.3 cm of the cathode plates and had a capacity of 2.5 liters of slurry. The anode weight to exposed cathode area ratio was 10 grs/$cm^2$ which corresponded to an anode/cathode area ratio of about 7.1 $cm^2$ of anode area per $cm^2$ of cathode area.

Cell No. 3 contained 9000 grams of shot covering 17.8 cm of cathode plates, the slurry capacity being 2 liters. The anode weight to exposed cathode area ratio was 10 grs/$cm^2$ which corresponded to an anode/cathode area ratio of about 7.1 $cm^2$ of anode area per $cm^2$ of cathode area.

In carrying out the tests, stock solutions of NaOH and reagent grade $NiSO_4$ added to de-ionized water were mixed and diluted to yield the appropriate $Ni^{+2}$ and free NaOH concentrations. The resultant slurry was recirculated in each cell for 15 minutes prior to start-up. The tests were continued until 100% oxidation was achieved (conversion of divalent nickel to the trivalent state), or for 30 hours, whichever occurred first. The samples were analyzed for percent oxidation by means of $Na_2S_2O_3$/EDTA titration and free NaOH by titration to pH 9.9 with 0.5N $H_2SO_4$.

The three cells were tested using slurry feeds of either 30 or 60 gpl Ni, 10 gpl free NaOH with nickel shot of average diameter ranging from about 0.75 to 1.25 centimeters (about $\frac{3}{8}$ inch average diameter). The following results were obtained:

Table 1

| Test No. | Cell No. | Amps | Amps/ KG Shot | AW/CA g/cm$^2$ | Ni gpl | Vol. L | % OX/Time %/Hrs. | Curr. Eff.,% | Ox Rate g Ni/Hr |
|---|---|---|---|---|---|---|---|---|---|
| 1 | 1 | 5 | 1.25 | 40 | 30 | 2.0 | 62/29 | 12 | 1.3 |
| 2 | 2 | " | 1.25 | 10 | " | 2.5 | 73/29 | 17 | 1.9 |
| 3 | 3 | " | 0.56 | 10 | " | 2.0 | 100/25 | 22 | 2.4 |
| 4 | 1 | 15 | 3.75 | 40 | 30 | 2.0 | 92/20 | 8.4 | 2.8 |
| 5 | 2 | " | 3.75 | 10 | " | 2.5 | 100/20 | 11 | 3.8 |
| 6 | 3 | " | 1.67 | 10 | " | 2.0 | 100/10 | 18 | 6.7 |
| 7 | 1 | 25 | 6.25 | 40 | 30 | 2.0 | 87/20 | 4.7 | 2.6 |
| 8 | 2 | " | 6.25 | 10 | " | 2.5 | 100/14 | 9.7 | 5.4 |
| 9 | 3 | " | 2.78 | 10 | " | 2.0 | 100/9 | 12 | 6.7 |
| 10 | 1 | 25 | 6.25 | 40 | 60 | 2.0 | 60/23 | 5.7 | 3.1 |
| 11 | 2 | " | 6.25 | 10 | " | 2.5 | 100/20 | 11 | 6.0 |
| 12 | 3 | " | 2.78 | 10 | " | 2.0 | 100/11 | 20 | 11 |
| 13 | 1 | 10 | 2.50 | 40 | 60 | 2.0 | 76/24 | 17 | 3.8 |
| 14 | 2 | " | 2.50 | 10 | " | 2.5 | 100/34 | 20 | 4.4 |
| 15 | 3 | " | 1.11 | 10 | " | 2.0 | 100/21 | 26 | 5.7 |

As will be observed, while the oxidation rate generally increases for Test Nos. 1–6 (Cell Nos. 1, 2 and 3) with increasing current, there is an accompanying decrease in current efficiency.

Comparison of results obtained at a given absolute current shows the effects of both anode current density (defined in this case as amps/Kg nickel shot) and the anode weight to cathode area ratio (AW/CA). For all absolute currents, the current efficiency in Cell 2 exceeds that in Cell 1 in spite of identical anode current densities (compare tests 1 and 2, 4 and 5, 7 and 8, 10 and 11). This effect is due to the lower AW/CA ratio in Cell 2, which results in a greater active anode surface area. In a stationary bed cell of this type, the potential at a given anode surface point is a strong function of the distance from that point to the nearest cathode surface. Since the rate of kinetically controlled electrochemical reactions of the type under investigation here are strongly potential dependent, it is not surprising that higher efficiencies are obtained at low AW/CA ratios, (where bed polarization is minimized.)

Figure 7:
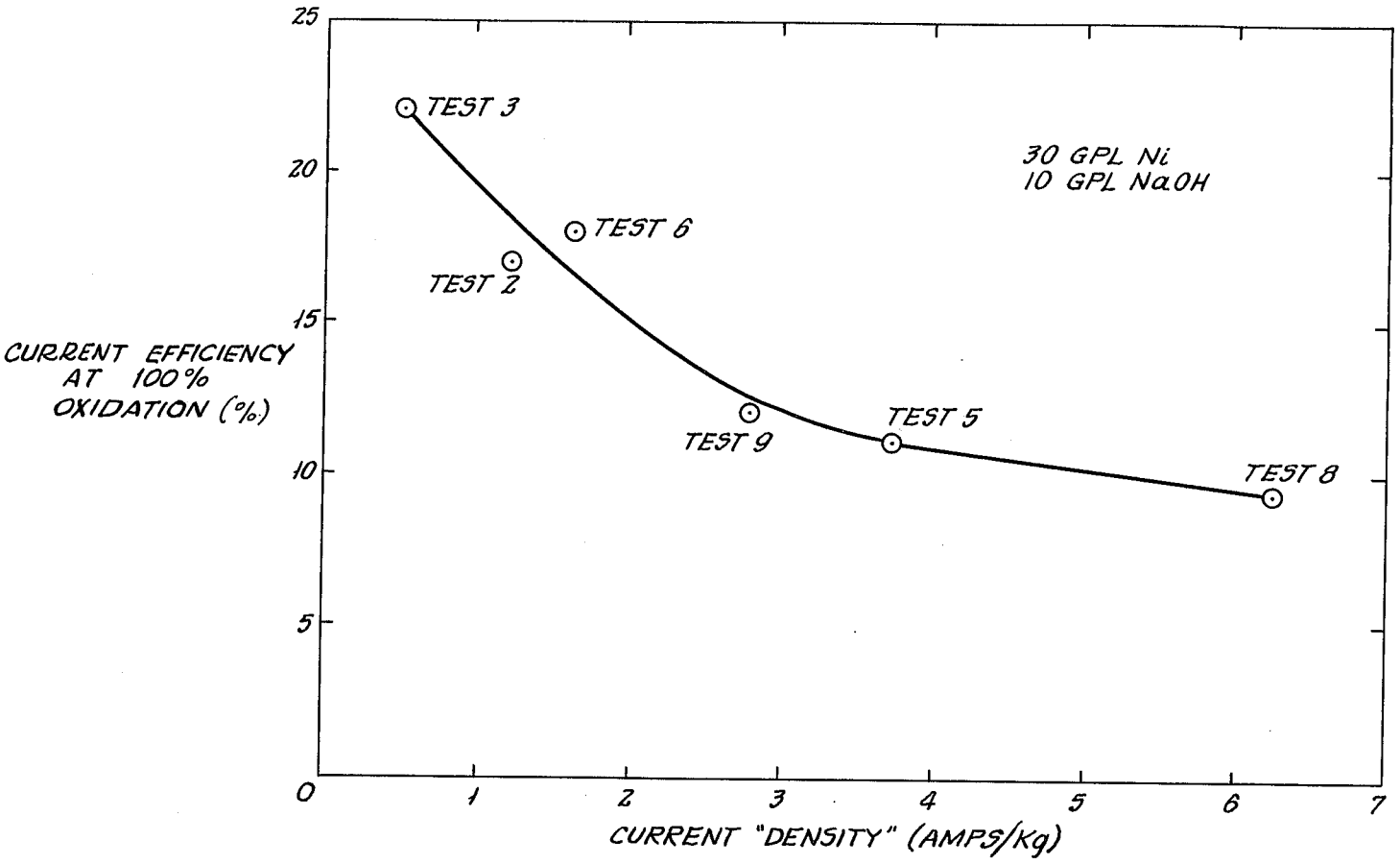
FIG. 7 is a curve showing current efficiency vs current density.

Comparison of results from Cells 2 and 3 (which have equal AW/CA ratios) at identical absolute currents, shows decreasing current efficiency with increasing current density. (Compare Tests 2 and 3, 5 and 6, 8 and 9, 11 and 12.) A plot of current efficiency vs current density for Cells 2 and 3 is shown in FIG. 7. The continuity of this plot verifies that with the configurations tested, and at equal AW/CA ratios, substantially the same current efficiency-current density relationship is obtained, regardless of the cell size.

The effect of increasing the nickel concentration from 30 to 60 gpl at various current densities is shown in Tests 7 and 10, 8 and 11, and 9 and 12. The increased slurry viscosity obtained at high nickel concentration precludes use of 60 gpl Ni in conventional parallel plate cells due to poor agitation. However, introduction of recirculating slurry at the top of the anode bed (and convection through the tortuous path created by the close packed anode shot) provides sufficient slurry mixing to operate at 60 gpl Ni in the packed bed configuration. At an AW/CA ratio of 10 g/cm$^2$, and a current density of 6.25 amps/Kg shot, increasing the nickel concentration from 30 to 60 gpl increases the current efficiency from 9.7 up to 11.0 percent (compare Tests 8 and 11).

At the same AW/CA ratio and at a current density of 2.78 amps/Kg shot, the current efficiency (and NiOOH production rate) increases from 12 up to 20 percent when the nickel concentration is increased from 30 to 60 gpl (compare Test 9 with 12). This result indicates that as the current density increases, the effect of nickel concentration on current efficiency decreases.

The above conclusions are substantiated by the data obtained at 10 amps and 60 gpl Ni (Tests 13, 14 and 15). For example, comparison of Test 3 with Test 15 shows that at low current densities, doubling the current density (0.56 vs 1.1 amp/Kg shot) and the nickel concentration more than doubles the nickelous oxidation rate (2.4 vs 5.7 g Ni/Hr), and increases the relative current efficiency (22 vs 26%).

Figure 8:
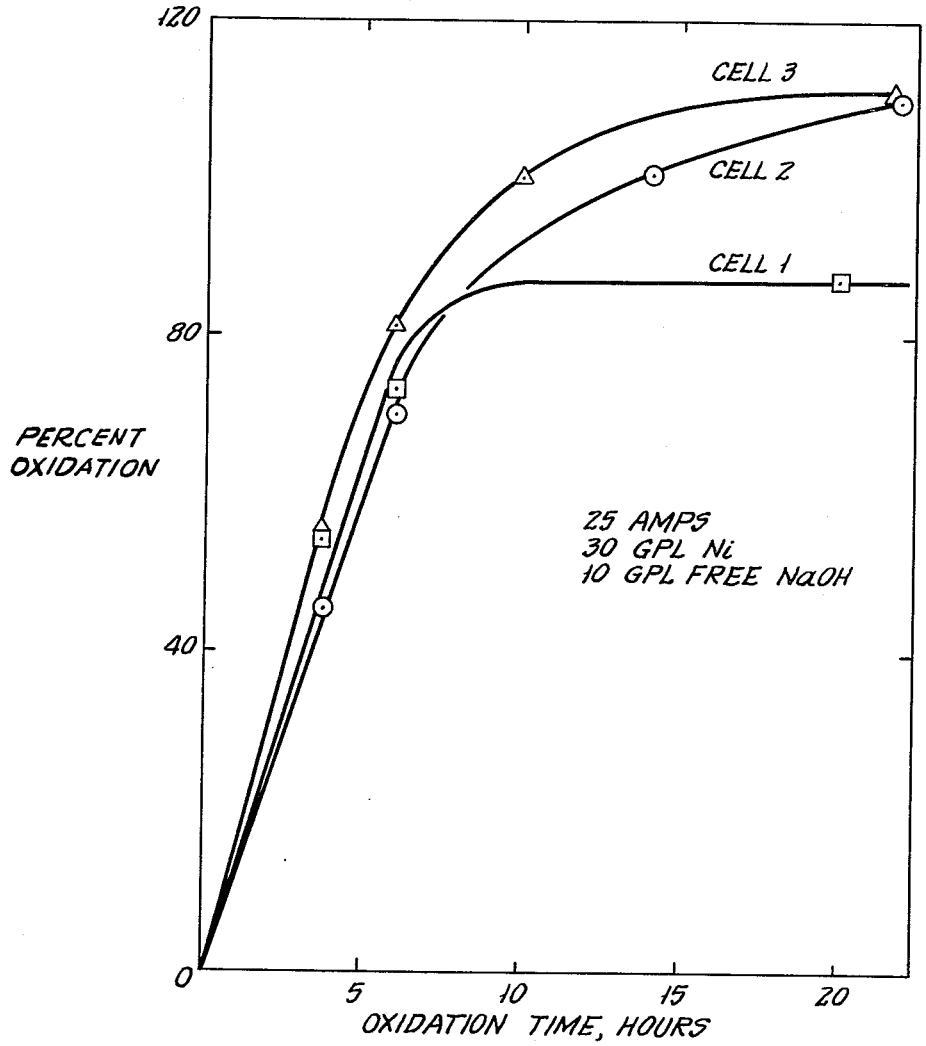
FIG. 8 is a plot showing percent oxidation as a function of time.

In most experiments, the degree of oxidation in Cell 1 did not reach 100 percent, even after 30 hours. As shown in FIG. 8, percent oxidation vs time plots are characterized by an initially near linear portion and a tailing portion that asymptotically approaches an upper limit, which is apparently determined by the AW/CA ratio. Note that although a lower rate of oxidation is observed initially in Cell 2 than Cell 3, the same degree of oxidation is finally attained in each, in spite of the higher current density in Cell 2. This merging of degree of oxidation is caused by an earlier decrease in reaction rate in Cell 3, since the concentration of divalent nickel approaches zero as the degree of oxidation approaches 100%.

Thus, in order to increase the degree of oxidation, the relatively inefficient oxidation of trivalent nickel to tetravalent nickel must occur. Under the same conditions in Cell 1, the rate of oxidation drops to nearly zero at 80 percent oxidized, indicating that the bed polarization is so severe at an AW/CA ratio of 42 that a negligible portion of the bed is at the potential required for efficient oxidation of $Ni(OH)_2$ at low $Ni^{+2}$ concentrations.

The effect of the free NaOH concentration was investigated in Cell No. 3 for a slurry containing 60 gpl $Ni^{+2}$ at 10 amps, 10 AW/CA and 2 liter cell volume and substantially the same results were obtained as compared to a conventional parallel plate cell treating a nickel concentration of 30 gpl. The results obtained are shown in Table 2 below.

Table 2

| Test No. | NaOH | % OX/Time %/Hrs. | Current Eff., % | OX Rate, g Ni/Hr. |
|---|---|---|---|---|
| 15 | 10 | 100/21 | 26 | 5.7 |
| 16 | 5 | 100/19.5 | 28 | 6.2 |
| 17 | pH 8 | 22/32 | 3.8 | 0.83 |

A slight improvement in current efficiency was obtained by decreasing the free NaOH concentration from 10 gpl to 5 gpl (Tests 15 and 16, respectively). Operation at pH 8 resulted in extremely low current efficiency (3.8%) due to the relative enhancement of $O_2$ evolution over $Ni^{+2}$ oxidation at that pH.

To determine the effect of increasing the anode surface area over that obtained using shot in the size range 0.75 to 1.24 cm (approximately 5/16 to ½ inch diameter), two tests were performed using shot in the 0.25 to 0.75 cm range (approximately 3/32 to 5/16 inch diameter). In one test (10 amps, 30 gpl $Ni^{+2}$, 10 gpl free NaOH), the current efficiency for 100 percent oxidation was 14 percent for the smaller shot size, compared to 20 percent under identical conditions using larger shot. In similar tests at 60 gpl Ni, the current efficiency using the smaller shot was 9 percent, while the larger shot test yielded 26 percent. These results (and visual inspection during the tests) indicate that slurry mixing with the smaller shot bed is minimal, leading to stagnant layers around the shot, particularly with the more viscous 60 gpl $Ni^{+2}$ slurry.

Thus, for consistent results, the nickel shot should exceed ⅛ inch diameter and range from about ¼ to 1 inch diameter, e.g., from about ⅜ to ¾ inch diameter. The range of diameter sizes can be expressed in terms of surface area per gram of nickel shot. That is to say, the size of the shot whether uniformly spherical or not may be such as to provide a surface area per gram of shot ranging from about 0.25 to 2 $cm^2$/gram (about 1 inch to between ⅜ and ¼ inch diameter) and preferably from about 0.35 to 1.5 $cm^2$/gram (this corresponds approximately to an average diameter of ¾ inch to slightly less than ¼ inch).

The perforations in the cathode coating should be that amount to provide sufficient exposed cathode substrate to assure the desired electrochemical properties of the circuit. The amount of area exposed on the insulated cathode may range from about 15 to 80% of the total area of the cathode and generally from about 20 to 70% of the total area. A preferred range is about 30% to 65% of the total area.

The amount of free NaOH in the nickel slurry may range from about 3 to 20 gpl and preferably from about 5 to 15 gpl.

The ratio of anode weight to exposed cathode area should not exceed about 30 grams/$cm^2$ and preferably range from about 2 to 25 grams/$cm^2$, for example, from about 5 to 20 grams/$cm^2$.

The results show that a relatively high current efficiency of 22% could be obtained for 100% $Ni(OH)_2$ oxidation using a fixed bed anode of nickel shot at a current input of 2.5 amps per liter or 5 amps per 2 liters (Test No. 3). This result compares very favorably with the 15% current efficiency obtained with the conventional parallel plate cell at 2 amps/liter. At 7.5 amps/liter or 15 amps per 2 liters, a very good current efficiency of 18% is obtained (Test No. 6). Operation at the foregoing conditions can greatly reduce the cell volume in view of the improved efficiency obtained with an anode bed of nickel pellets.

As stated earlier, an important advantage of the invention is that the packed bed can treat a slurry containing as much as 60 gpl of $Ni^{+2}$ as compared to the lower amount of 30 gpl $Ni^{+2}$ treated in a conventional cell. At a current of 12.5 amps/liter (or 25 amps per 2 liters) with a slurry corresponding to 60 gpl $Ni^{+2}$ and 10 gpl of free NaOH, the current efficiency was 20% (Test No. 12).

Thus, the electrolytic oxidation cell provided by the invention may handle $Ni(OH)_2$ slurries containing about 15 grams $Ni^{+2}$/liter to 100 grams/liter and generally from about 30 grams $Ni^{+2}$/liter to 80 grams/liter, for example, 40 to 70 gpl $Ni^{+2}$.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A method of oxidizing nickelous hydroxide to substantially the nickelic state which comprises, forming an aqueous slurry of said nickelous hydroxide containing free sodium hydroxide, feeding said slurry to an electrolytic oxidation cell comprising an anode in the form of a supported fixed bed of nickel pellets and a plurality of parallel-connected cathodes extending into and in contact with the bed of said pellets, said cathodes being covered with a perforated layer of electrically insulating material to inhibit electrical shorting of said cathodes with said bed of nickel pellets, electrically activating said cell, and circulating said hydroxide slurry through said anode bed for a time sufficient to effect oxidation of said nickelous hydroxide to substantially the nickelic state.

2. The method of claim 1, wherein the slurry is circulated through the cell with the perforated layer of the cathode providing an exposed area of about 15% to 80% of the total cathode area.

3. The method of claim 2, wherein the slurry is circulated through the cell with the perforated layer of the cathode providing an exposed area of about 20% to 70% of the total cathode area.

4. The method of claim 3, wherein the slurry is circulated through the cell with the weight ratio of the anode to the exposed cathode area ranging from about 2 to 25 grams/$cm^2$.

5. The method of claim 2, wherein the slurry is circulated through the cell with the weight ratio of the anode to the exposed cathode area not exceeding about 30 grams/$cm^2$.

6. The method of claim 1, wherein said slurry is circulated through said bed of pellets having a size such that the anode surface area corresponds to about 0.25 to 2 $cm^2$/gram of pellets.

7. The method of claim 6, wherein said slurry is circulated through said bed of pellets having a surface area corresponding to about 0.35 to 1.5 $cm^2$/gram of pellets.

8. A method of oxidizing nickelous hydroxide to substantially the nickelic state which comprises, forming an aqueous slurry of said nickelous hydroxide containing about 15 to 100 gpl of $Ni^{+2}$ and free sodium hydroxide in an amount ranging from about 3 to 20 gpl, feeding said slurry to an electrolytic oxidation cell comprising an anode in the form of a supported fixed bed of nickel pellets of average size corresponding to a surface area of about 0.25 to 2 $cm^2$/gram of pellets and a plurality of parallel-connected cathodes extending into and in contact with the bed of said pellets, said cathodes being covered with a perforated layer of electrically insulating material to inhibit electrical shorting of said cathodes with said bed of nickel pellets, electrically activating said cell, and circulating said hydroxide slurry through said anode bed for a time sufficient to effect oxidation of said nickelous hydroxide to substantially the nickelic state.

9. The method of claim 8, wherein the slurry is circulated through the cell with the perforated layer of the cathode providing an exposed area of about 15% to 80% of the total cathode area.

10. The method of claim 9, wherein the slurry is circulated through the cell with the perforated layer of the cathode providing an exposed area of about 20% to 70% of the total cathode area.

11. The method of claim 10, wherein the slurry is circulated through the cell with the weight ratio of the anode to the exposed cathode area ranging from about 2 to 25 grams/$cm^2$.

12. The method of claim 9, wherein the slurry is circulated through the cell with the weight ratio of the anode to the exposed cathode area not exceeding about 30 grams/$cm^2$.

13. The method of claim 8, wherein said nickelous hydroxide slurry contains about 30 to 80 gpl $Ni^{+2}$ and about 5 to 15 gpl free NaOH.

14. The method of claim 8, wherein said slurry is circulated through said bed of pellets having a surface area corresponding to about 0.35 to 1.5 $cm^2$/gram of pellets.

15. An electrolytic oxidation cell for anodically oxidizing a metal hydroxide slurry from a state of lower valence to a state of higher valence, said cell comprising:

an anode in the form of a supported bed of nickel pellets, a plurality of parallel-connected cathodes extending into and in contact with said bed of pellets, said cathodes each being covered by a perforated layer of electrically insulating material to inhibit electrical shorting of said cathodes with said bed of nickel pellets, and means for maintaining a circulation of said metal hydroxide slurry throughout the bed of said nickel pellets whereby to effect oxidation of said metal hydroxide to a higher valence state when said cell is electrically activated.

16. The electrolytic cell of claim 15, wherein the size of said pellets of nickel is such as to provide an anode surface area corresponding to about 0.25 to 2 $cm^2$/gram of pellets.

17. The electrolytic cell of claim 16, wherein the anode surface area corresponds to about 0.35 to 1.5 $cm^2$/gram of pellets.

18. The electrolytic cell of claim 15, wherein the perforated layer on the cathode provides an exposed cathode area ranging from about 15% to 80% of the total cathode area.

19. The electrolytic cell of claim 18, wherein the perforated layer on the cathode provides an exposed cathode area ranging from about 20% to 70% of the total cathode area.

20. The electrolytic cell of claim 15, wherein the weight of the anode bed relative to the exposed cathode area does not exceed 30 grams/$cm^2$.

21. The electrolytic cell of claim 20, wherein the weight of the anode bed relative to the exposed cathode area ranges from about 2 to 25 grams/$cm^2$.

22. The electrolytic cell of claim 15, wherein said cathodes are in the form of rods.

23. The electrolytic cell of claim 15, wherein said cathodes are in the form of plates.

24. An electrolytic oxidation cell for anodically oxidizing a metal hydroxide slurry from a state of lower valence to a state of higher valence, said cell comprising:

an anode in the form of a supported bed of nickel pellets of average size corresponding to a surface area of about 0.25 to 2 $cm^2$/gram of pellets, a plurality of parallel-connected cathodes extending into and in contact with said bed of pellets, said cathodes each being covered by a perforated layer of electrically insulating material to inhibit electrical shorting of said cathodes with said bed of nickel pellets, the perforated layer providing an exposed cathode area ranging from about 15% to 80% of the total cathode area, and means for maintaining a circulation of said metal hydroxide slurry throughout the bed of said nickel pellets whereby to effect oxidation of said metal hydroxide to a higher valence state when said cell is electrically activated.

25. The electrolytic cell of claim 24, wherein the weight of the anode bed relative to the exposed cathode area does not exceed 30 grams/$cm^2$.

26. The electrolytic cell of claim 25, wherein the weight of the anode bed relative to the exposed cathode area ranges from about 2 to 25 grams/$cm^2$.

27. The electrolytic cell of claim 24, wherein the anode surface area corresponds to about 0.35 to 1.5 $cm^2$/gram of pellets.

28. The electrolytic cell of claim 24, wherein the perforated layer on the cathode provides an exposed cathode area ranging from about 20% to 70% of the total cathode area.

29. The electrolytic cell of claim 24, wherein said cathodes are in the form of rods.

30. The electrolytic cell of claim 24, wherein said cathodes are in the form of plates.

31. An electrolytic oxidation cell for anodically oxidizing a metal hydroxide slurry from a state of lower valence to a state of higher valence, said cell comprising:

an anode in the form of a supported bed of nickel pellets of average size corresponding to a surface area of about 0.25 to 2 $cm^2$/grams of pellets, a plurality of parallel-connected cathodes extending into and in contact with said bed of pellets, said cathodes each being covered by a perforated layer of electrically insulating material to inhibit electrical shorting of said cathodes with said bed of nickel pellets, the perforated layer providing an exposed cathode area ranging from about 15% to 80% of the total cathode area, the weight ratio of said anode relative to the exposed cathode area ranging up to about 30 grams/$cm^2$, and means for maintaining a circulation of said metal hydroxide slurry throughout the bed of said nickel pellets whereby to effect oxidation of said metal hydroxide to a higher valence state when said cell is electrically activated.

32. The electrolytic cell of claim 31, wherein the anode surface area corresponds to about 0.35 to 1.5 $cm^2$/gram of pellets.

33. The electrolytic cell of claim 31, wherein the perforated layer on the cathode provides an exposed cathode area ranging from about 20% to 70% of the total cathode area.

34. The electrolytic cell of claim 31, wherein the weight of the anode bed relative to the exposed cathode area ranges from about 2 to 25 grams/$cm^2$.

35. The electrolytic cell of claim 31, wherein said cathodes are in the form of rods.

36. The electrolytic cell of claim 31, wherein said cathodes are in the form of plates.

* * * * *